US010646760B2

(12) United States Patent
Hinnen, III

(10) Patent No.: US 10,646,760 B2
(45) Date of Patent: May 12, 2020

(54) SNOWBALL LAUNCHING AND BATTING APPARATUS

(71) Applicant: John Hinnen, III, Peoria, IL (US)

(72) Inventor: John Hinnen, III, Peoria, IL (US)

( * ) Notice: Subject to any disclaimer, the term of this patent is extended or adjusted under 35 U.S.C. 154(b) by 0 days.

(21) Appl. No.: 15/971,941

(22) Filed: May 4, 2018

(65) Prior Publication Data

US 2018/0326272 A1 Nov. 15, 2018

Related U.S. Application Data

(60) Provisional application No. 62/602,873, filed on May 9, 2017.

(51) Int. Cl.

| | |
|---|---|
| ***A63B 60/38*** | (2015.01) |
| ***A63B 60/14*** | (2015.01) |
| ***A63B 65/12*** | (2006.01) |
| ***A63B 59/50*** | (2015.01) |
| ***A63B 102/00*** | (2015.01) |
| ***A63B 59/58*** | (2015.01) |
| ***A63B 60/00*** | (2015.01) |

(52) U.S. Cl.

CPC ..... *A63B 60/38* (2015.10); *A63B 59/50* (2015.10); *A63B 60/14* (2015.10); *A63B 65/122* (2013.01); *A63B 59/58* (2015.10); *A63B 2060/0085* (2015.10); *A63B 2102/00* (2015.10); *A63B 2210/50* (2013.01)

(58) Field of Classification Search

CPC ..... A63B 60/38; A63B 59/58; A63B 60/14; A63B 2102/00

See application file for complete search history.

(56) References Cited

U.S. PATENT DOCUMENTS

| | | | | |
|---|---|---|---|---|
| 2,948,275 | A | 8/1960 | Smith | |
| 3,059,273 | A | 10/1962 | Blevins, Jr. et al. | |
| 3,472,217 | A * | 10/1969 | Erickson | A63H 33/00 124/5 |
| 3,765,396 | A * | 10/1973 | Kienholz | F41B 11/50 124/44.7 |
| 4,521,015 | A | 6/1985 | Carafeno | |
| 5,000,153 | A | 3/1991 | Zimmerman et al. | |
| 5,253,873 | A * | 10/1993 | Grattan | F41B 7/00 124/16 |
| 5,624,115 | A | 4/1997 | Baum | |

(Continued)

*Primary Examiner* — Jeffrey S Vanderveen

(74) *Attorney, Agent, or Firm* — Singleton Law Firm, P.C.

(57) ABSTRACT

A snowball launching and batting apparatus comprising a barrel member, a handle member, and a knob feature, the handle member further comprising a primary cradle structure configured to accept, form, and store snow or snowballs. The apparatus further comprises a secondary cradle structure capable of coupling the primary cradle structure and configured to accept, form, and store snow or snowballs. The knob feature may further comprise a depression configured to form snowballs. The apparatus is further configured to have an extended and retracted state. A user inserts snow into the barrel and cradle structure to form a snowball and inserts it into the apparatus while in an extended state. Launching the snowballs from the apparatus may comprise swinging the apparatus or applying a force to the handle member to quickly move it from an extended state to a retracted state.

15 Claims, 11 Drawing Sheets

(56) References Cited

U.S. PATENT DOCUMENTS

| | | | | |
|---|---|---|---|---|
| 5,741,193 | A * | 4/1998 | Nolan | A63B 15/00 473/457 |
| 7,128,556 | B2 | 10/2006 | Wessells et al. | |
| D567,602 | S | 4/2008 | Choy et al. | |
| 7,815,429 | B1 | 10/2010 | Clark, Jr. | |
| 8,302,585 | B2 | 11/2012 | FitzGerald | |
| 9,278,269 | B2 * | 3/2016 | Chen | A63B 47/002 |
| 2002/0137581 | A1 | 9/2002 | Wang | |
| 2009/0252822 | A1 * | 10/2009 | Palmer | A63H 33/00 425/318 |

* cited by examiner

10

10

SNOWBALL LAUNCHING AND BATTING APPARATUS

CROSS-REFERENCE TO RELATED APPLICATIONS

This invention claims priority from the previously filed provisional application, U.S. Pat. No. 62/602,873, filed May 9, 2017; the contents of which are herein incorporated by reference.

BACKGROUND OF THE INVENTION

The present invention relates to sports and toy equipment design and manufacture. Specifically, a snowball-launching and batting apparatus with a retractable handle and cup member capable of quickly forming and launching snowballs, as well as storing formed snowballs and deflecting incoming snowballs from hitting a user.

The activity of a snow or snowball fight has been winter hallmark for decades, if not centuries. During such activities, the abundance of fallen snow to throw at a colleague or opponent may lead to limitless enjoyment for all parties. The activity itself may be seen as challenging in that an individual must exercise expediency in forming snowballs as well as keen senses to avoid being hit by an opponent's thrown snowballs. In order to aid in forming snowballs, formation assisting devices were designed to decrease the time to form a snowball.

Snowball formation devices known in the art usually comprise a clamp or molding apparatus designed to accept an amount of unformed snow inserted by a user, clamped or had a force exerted on it, and then removing the formed snowball for either immediate use or short-term storage in an area of play. These devices are usually more time-consuming than simply forming the snowballs by hand and either lack a launching mechanism or have a launching mechanism that further prolongs snowball formation and launch times.

Ball launchers known in the art are either configured to launch a single ball at a time or rely on pneumatic action to propel balls. Limited capacities further hamper the problems associated with modern snowball launching bats. A snowball fight relies on timeliness and efficiency in both forming and launching snowballs at an opponent. A device that can only make and launch one ball at time puts the user at a disadvantage, or renders the entire act of using the device moot as opposed to use of a user's hands.

Use of pneumatic mechanisms in ball launchers in the art has allowed for increased ranges when launching a ball. However, these mechanisms may be large, and the force associated with even weaker pneumatic mechanisms may prove too much when applied to a snowball. The force of launching a snowball from a pneumatic launcher would likely result in disintegration of the snowball upon launch, further rendering the use of such a launcher as a disadvantage.

Ball launchers known in the art are also inefficient when applied to the activities of forming snowballs. Known launchers utilize flat piston heads to propel balls, forcing a snowball-based user to form the snowballs separately and then insert them into the launcher for use. This lacks the formation efficiency and timeliness required for snowball fights. Other ball launching devices that utilize a rounded piston or cradle to hold the ball implement different structures to form said cradle. Aside from still lacking capacity for multiple snowballs, these devices still impede a user's ability to form snowballs with the launcher. Gaps between the sections of the cradle allow snow to be forced through them and into the other portions of the device, introducing problems with clean-up and maintenance, especially where pneumatics are used in the device.

Snowball launching devices have not been made to facilitate expedient formation of snowballs, nor have launchers been made to allow higher launch capacities and an ability to both utilize the structure of the launcher and the user's own mechanical force to defend against and successfully launch a semi-solid ball such as a snowball.

The present invention attempts to remedy the shortcomings of prior art ball launchers by providing a snowball launching and batting apparatus capable of expedient formation and delivery of snowballs at an opponent, efficient snowball capacity and storage, and structural stability for defending against incoming snowballs.

BRIEF DESCRIPTION OF THE INVENTION

The present invention provides a snowball launching and batting apparatus capable of expedient formation and delivery of snowballs at an opponent, efficient snowball capacity and storage, and structural stability for defending against incoming snowballs. In one embodiment of the invention, the snowball launching and batting apparatus is configured to have an extended state and a retracted state. The snowball launching and batting apparatus further comprises a barrel member comprising a cylindrical enclosure and having a first opening and a second opening, a handle member comprising a cylindrical structure and having a first and a second end, and a knob feature. The first opening of the barrel member is configured to accept a snowball of a diameter and both the first and second ends of the handle member. The second end of the barrel member is configured to accept the second end of the handle member while also configured to couple and retain the first end of the handle member.

The first end of the handle member comprises a primary cradle structure, further configured to accept and movably retain a snowball. The second end of the handle member comprises a threaded hole, configured to couple and retain the knob feature. The knob feature comprises an oblate ellipsoid having an extended member further comprising threading configured to couple the threaded hole of the handle member.

In one embodiment, an interior of the barrel member enclosure further comprises a plurality of threading structures disposed upon a surface at an end and configured to retain the primary cradle structure of the handle member. In some embodiments, the interior of the barrel member enclosure may comprise the plurality of threading structures at both ends of the barrel member, while other embodiments may comprise the plurality of threading structures at a single end.

In another embodiment, the primary cradle structure further comprises threading features along a surface and configured to couple the plurality of threading structures of the interior of the barrel member.

In another embodiment, the snowball launching and batting apparatus further comprises a secondary cradle structure comprising a hollowed semi-hemispherical configured to accept an amount of snow or at least one snowball and allow formation of a snowball when snow is pressed between the cradle and a user's hand. The secondary cradle structure further comprises a lip member extending from an equator of the semi-spherical surface and configured to couple the primary cradle structure of the handle member.

In another embodiment, the lip member secondary cradle structure further comprises threading features disposed along a surface, configured to couple the plurality of threading structures of the interior surface of the barrel member.

In yet another embodiment, the knob feature of the snowball launching and batting apparatus further comprises a depression disposed into a surface of the knob feature and configured to accept, form, and store snow or at least one snowball.

In another embodiment, the plurality of threading structures of the interior surface of the barrel member and the threading features of either the primary or secondary cradle structure are further configured to couple one another such that when the threading features of a cradle structure couples the interior threading structures of the first opening of the barrel member, the snowball launching and batting apparatus is retained in the retracted state. Likewise, when the threading features of a cradle structure couples the interior threading structures of the second opening of the barrel member, the snowball launching and batting apparatus is retained in the extended state.

In another embodiment of the invention, the handle member further comprises a handle stop structure coupled to and spanning the circumference of the handle structure. The handle stop structure is disposed upon the handle in such a position as to disallow the handle from moving completely into the barrel member while still allowing a user's hands to grip the handle.

In one embodiment of the invention, a user may insert snow or at least one snowball into the interior of the barrel member while the snowball launching and batting apparatus is in the extended state, grip the handle member, and swing the snowball launching and batting apparatus in an arcing motion to launch the at least one snowball.

In another embodiment of the invention, a user may insert snow or at least one snowball into the interior of the barrel member while the snowball launching and batting apparatus is in the extended state; grip the handle member and twist the handle member such that the threading features of a cradle structure decouples the interior threading structures of the second opening of the barrel member; and apply a force to the handle member along an axis of the snowball launching and batting apparatus such that the apparatus quickly move from the extended state to the retracted state, thereby applying force to and launching the snow or at least one snowball from the apparatus.

In yet another embodiment, a user may insert snow into the interior of the barrel member while the snowball launching and batting apparatus is in the retracted state, thus inserting the snow into the primary cradle structure. The user then packs the snow into the cradle structure to form a snowball.

The methods, systems, and apparatuses are set forth in part in the description which follows, and in part will be obvious from the description, or can be learned by practice of the methods, apparatuses, or can be learned by practice of the methods, apparatuses, and systems. The advantages of the methods, apparatuses, and systems will be realized and attained by means of the elements and combinations particularly pointed out in the appended claims. It is to be understood that both the foregoing general description and the following detailed description are exemplary and explanatory only and are not restrictive of the methods, apparatuses, and systems, as claimed. More details concerning these embodiments, and others, are further described in the following figures and detailed description set forth herein below.

DETAILED DESCRIPTION OF THE INVENTION

The present invention is described in reference to the accompanying drawings and following embodiments that are presented for the purpose of illustration and should not be construed to limit the scope of the invention thereto.

Figure 1A:
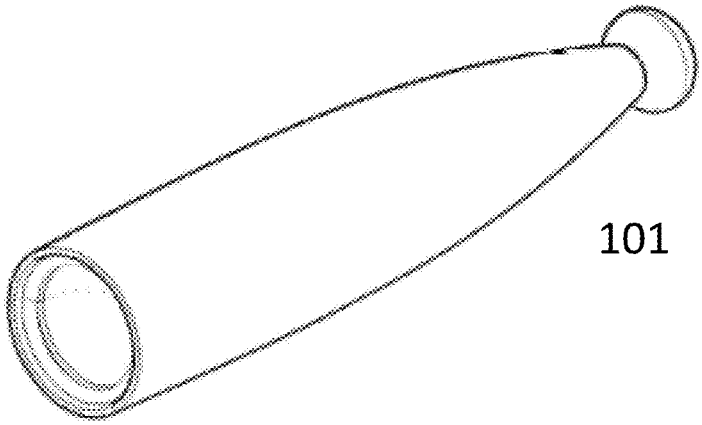
FIG. 1A illustrates perspective view the snowball launching and batting apparatus configured in a retracted state.
Figure 1B:
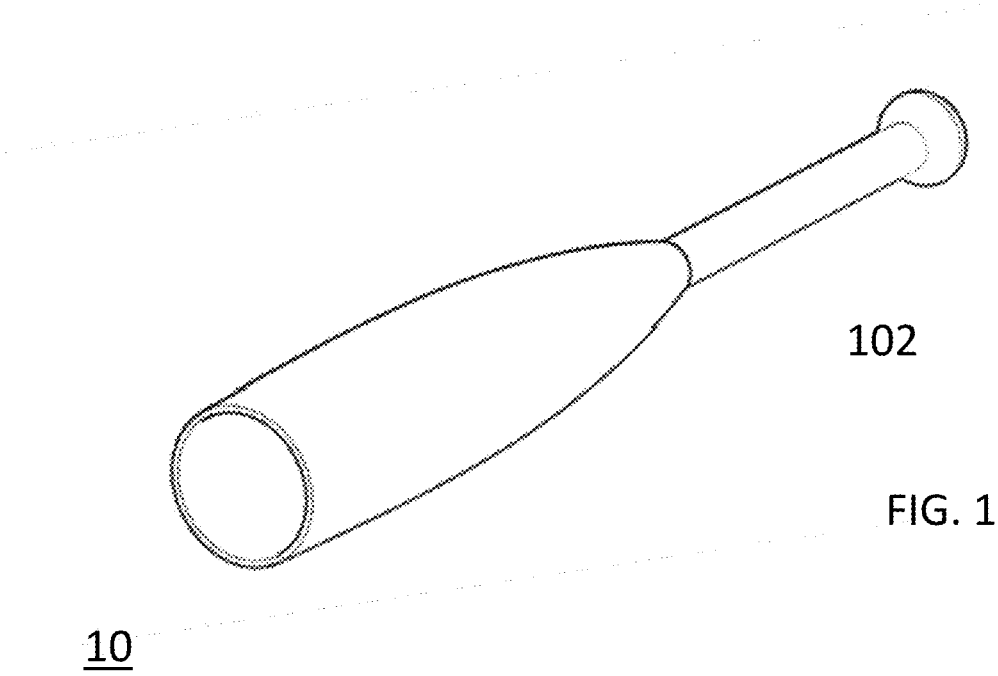
FIG. 1B illustrates a perspective view of snowball launching and batting apparatus configured in an extended state.
Figure 2:
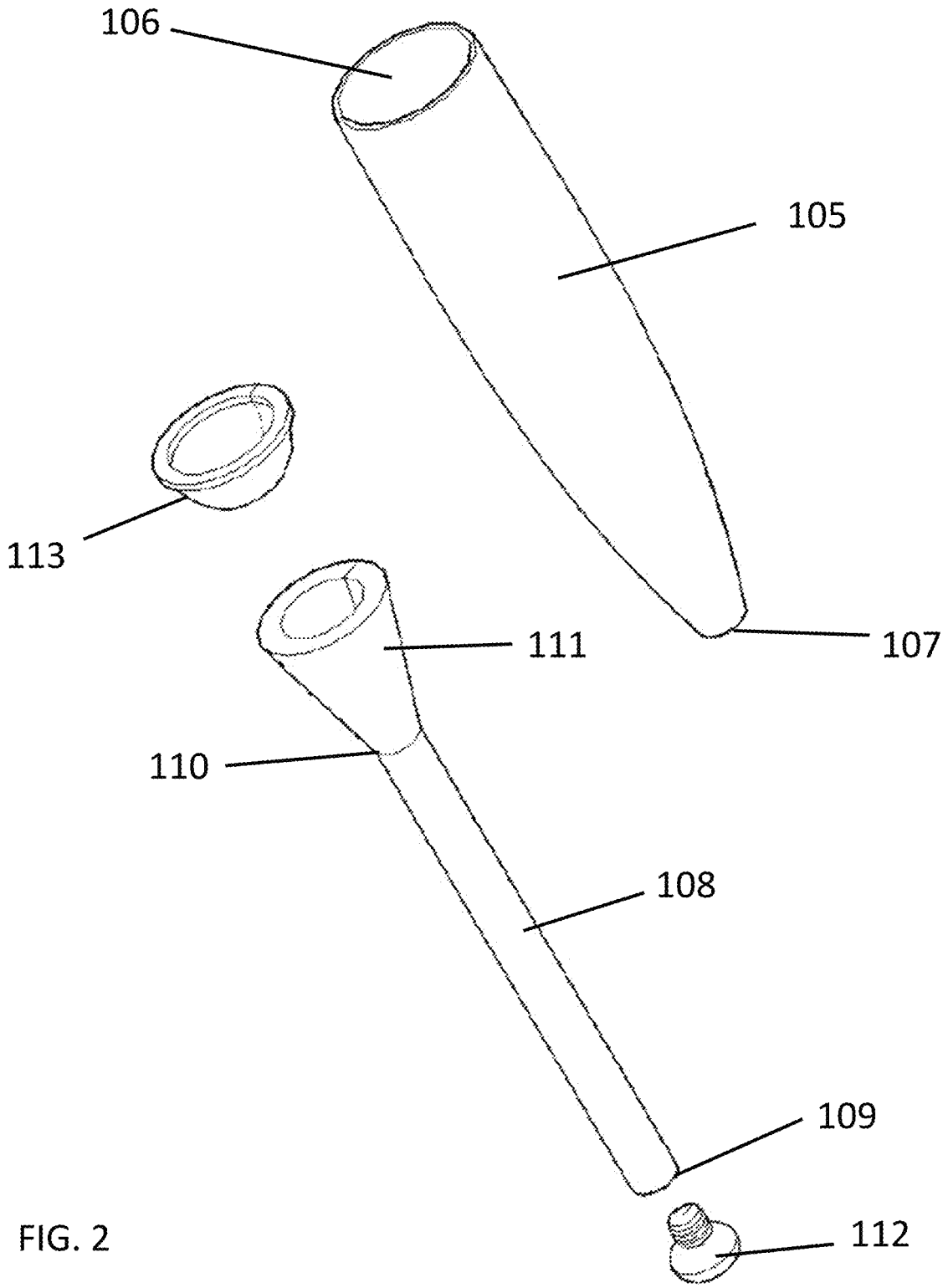
FIG. 2 illustrates and exploded view of the snowball launching and batting apparatus of the present invention.
Figure 3:
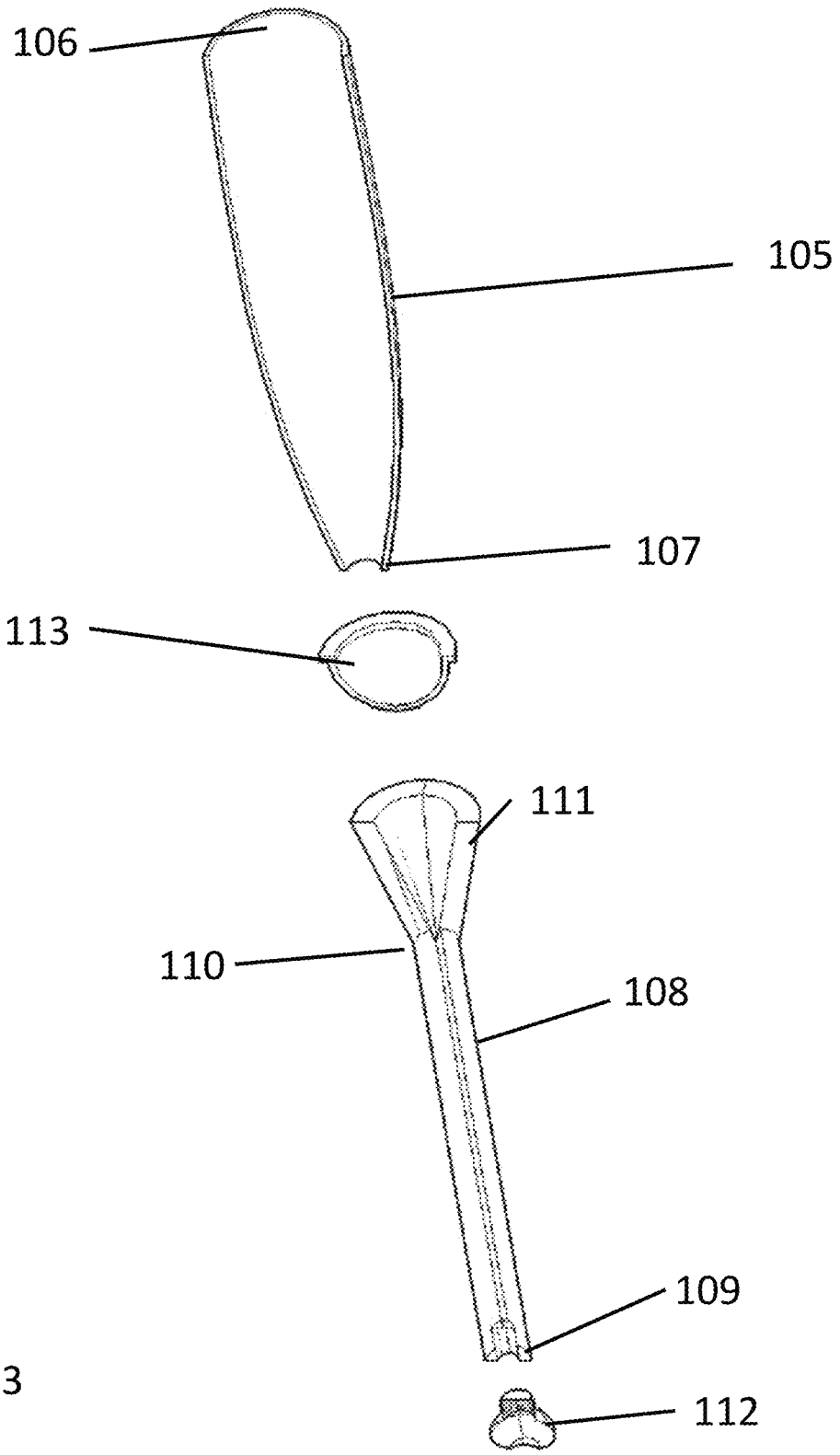
FIG. 3 illustrates an exploded cutaway view of the snowball launching and batting apparatus of the present invention.

FIGS. 1A-B illustrates perspective views of one embodiment of a snowball launching and batting apparatus 10. The snowball launching and batting apparatus 10 is configured to have an extended state 101, shown in FIG. 1A, and a retracted state 102, shown in FIG. 1B. The snowball launching and batting apparatus 10, as shown in FIGS. 2-3, comprises: a barrel member 105 comprising a cylindrical enclosure and having a first opening 106 and a second opening 107; a handle member 108 comprising a cylindrical structure and having a first and a second end 109; and a knob feature 112 coupled to the second end 109 of the handle member 108.

Figure 4:
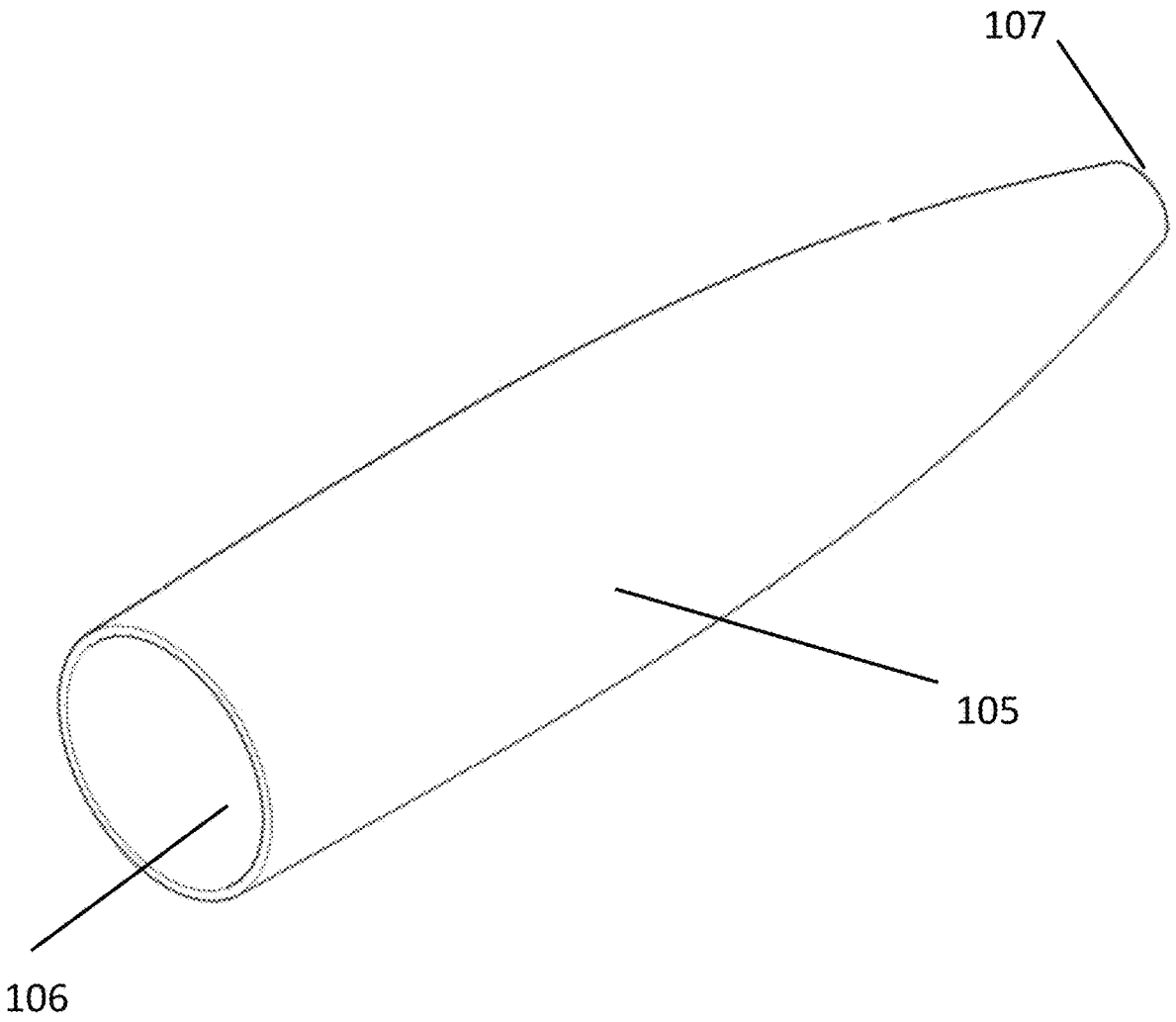
FIG. 4 illustrates a perspective view of the barrel member of the snowball launching and batting apparatus of the present invention.

The barrel member 105, shown in FIG. 4, comprises an overall ellipsoid shape, with the first opening 106 and the second opening 107 having a diameter differing from a diameter of a midpoint of the barrel member 105. The first opening 106 of the barrel member 105 is further configured with sufficient diameter to freely accept and allow movement of a snowball of a diameter and both the first end 110 and the second end 109 of the handle member 108. The second opening 107 of the barrel member 105 is configured to accept and allow movement of the second end 109 of the handle member 108 while also configured to retain the first end 110 of the handle member 108. The first opening 106 and the second opening 107 of the barrel member 105 further comprises a tapering section, wherein the diameters decrease in size when moving away from a center of the barrel member 105.

Figure 5A:
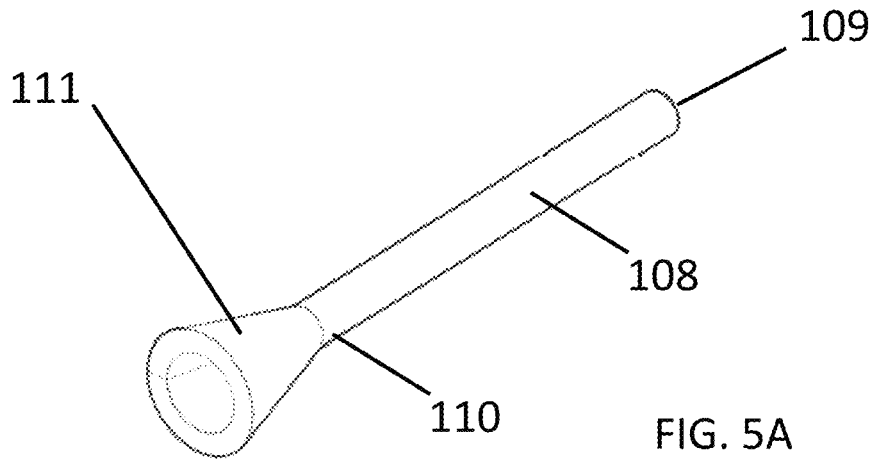
FIG. 5A illustrates a perspective view of the handle member of the snowball launching and batting apparatus of the present invention.
Figure 5B:
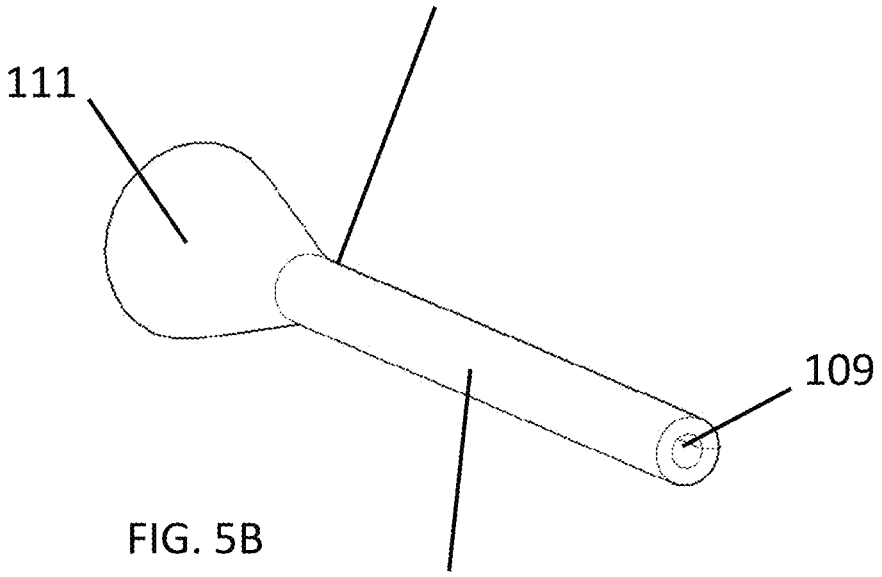
FIG. 5B illustrates another perspective view of the handle member of the snowball launching and batting apparatus of the present invention.
Figure 5C:
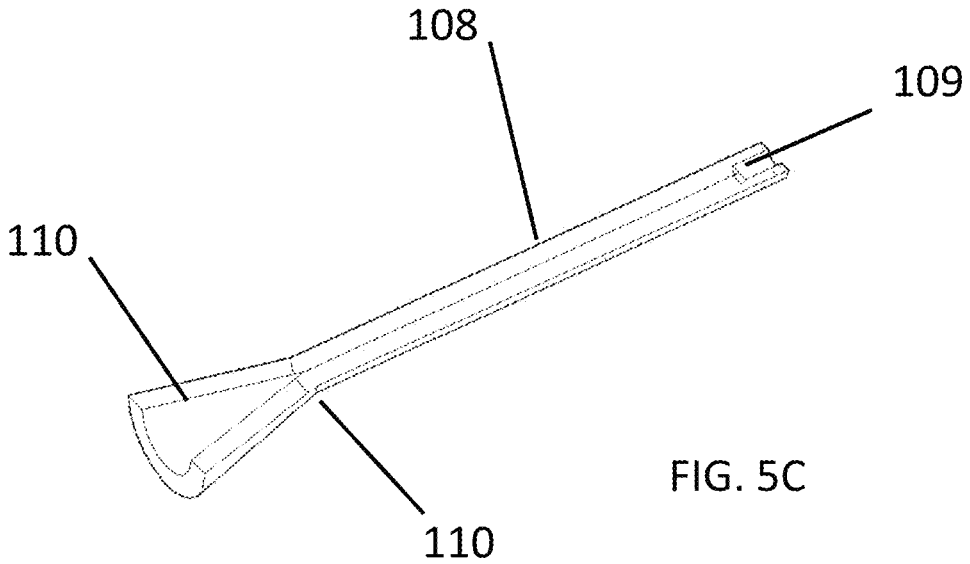
FIG. 5C illustrates a cutaway perspective view of the handle member of the snowball launching and batting apparatus of the present invention.

The handle member 108, shown in FIGS. 5A-C, comprises an overall cylindrical shape with the first end 110 comprising a primary cradle structure 111 configured to accept and movably retain an amount of snow or at least one snowball and allow formation of a snowball when snow is pressed between the cradle and a user's hand. The primary cradle structure 111 may be configured in the shape of a cone, a semi-spherical ellipsoid, or any other shape known in the art facilitating snowball coupling and storage, and may also be configured with tapering surfaces. The second end 109 of the handle member 108 further comprises a hole disposed within the end and spanning a distance along a central axis of the handle member 108. The hole further comprises threaded features disposed along an interior surface of the hole, configured to couple and retain the knob feature 112 of the snowball launching and batting apparatus 10.

In some embodiments, the handle member 108 further comprises surface features disposed upon a surface, the features configured to facilitate a user's grip during use of the invention.

Figure 6:
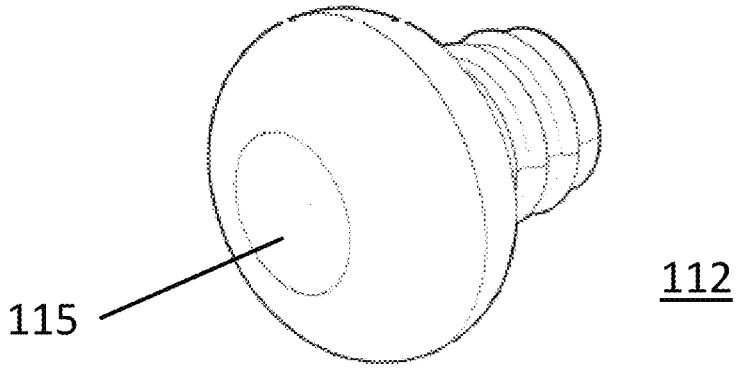
FIG. 6 illustrates a perspective view of the knob feature of the snowball launching and batting apparatus of the present invention.
Figure 7:
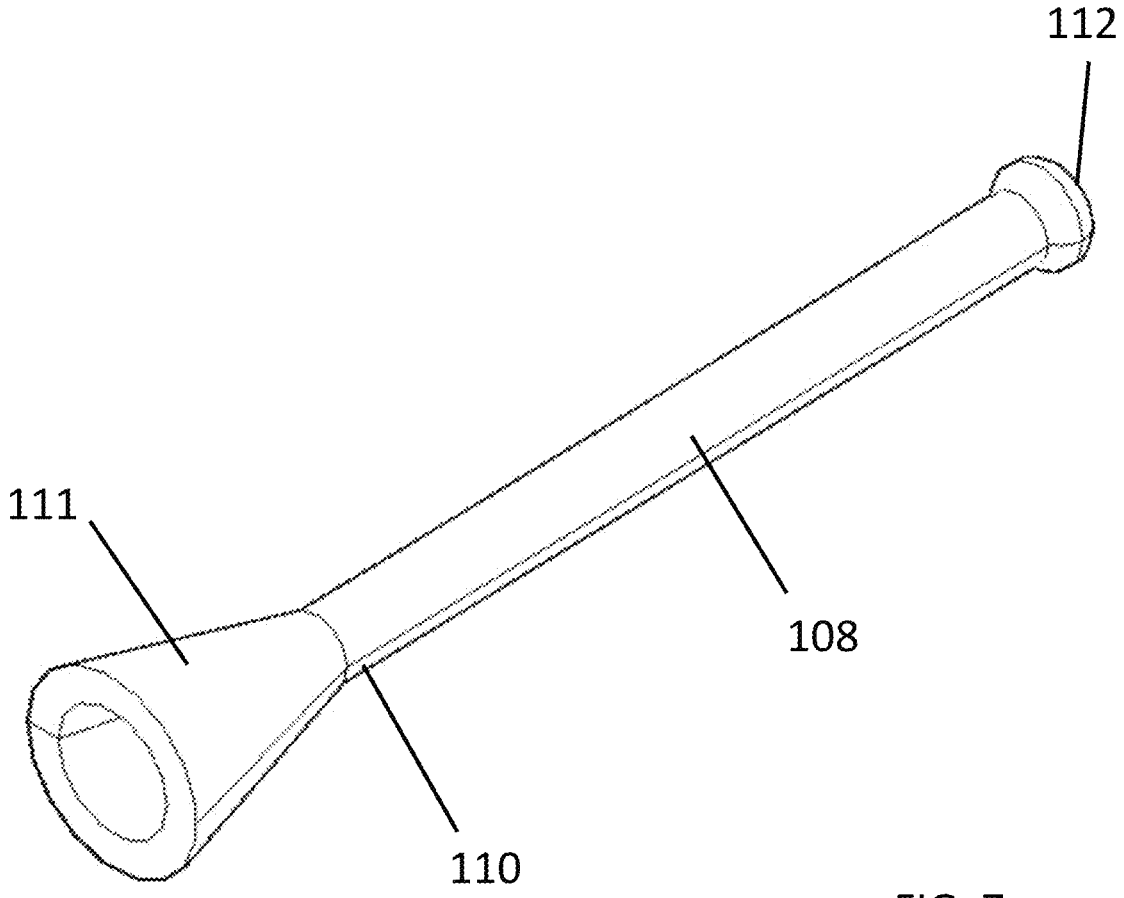
FIG. 7 illustrates a perspective view of the coupled handle member and knob feature of the snowball launching and batting apparatus of the present invention.

The knob feature 112 of the snowball launching and batting apparatus 10, shown in FIG. 6, comprises an oblate ellipsoid structure coupled to a cylindrical elongate member. The elongate member further comprises threading disposed along the cylindrical elongate member and configured to couple the hole of the second end 109 of the handle member 108, as shown in FIG. 7. A person ordinary skill will appreciate that the knob feature 112 may be coupled to the handle member 108 by way of other connection methods including but not limited to friction fitting, chemical bonding, or injection molding.

In some embodiments, the knob structure may further comprise a circular depression 115 disposed in a surface of the oblate ellipsoid and configured to accept snow or at least one snowball and allow formation of a snowball when snow is pressed between the depression 115 and a user's hand.

Figure 8A:
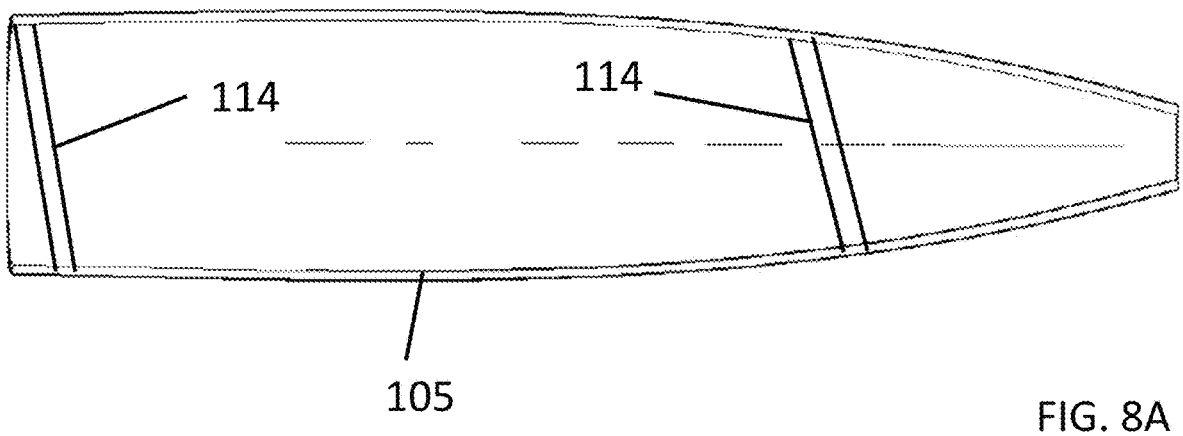
FIG. 8A illustrates a cutaway profile view of the barrel member of the snowball launching and batting apparatus of the present invention.
Figure 8B:
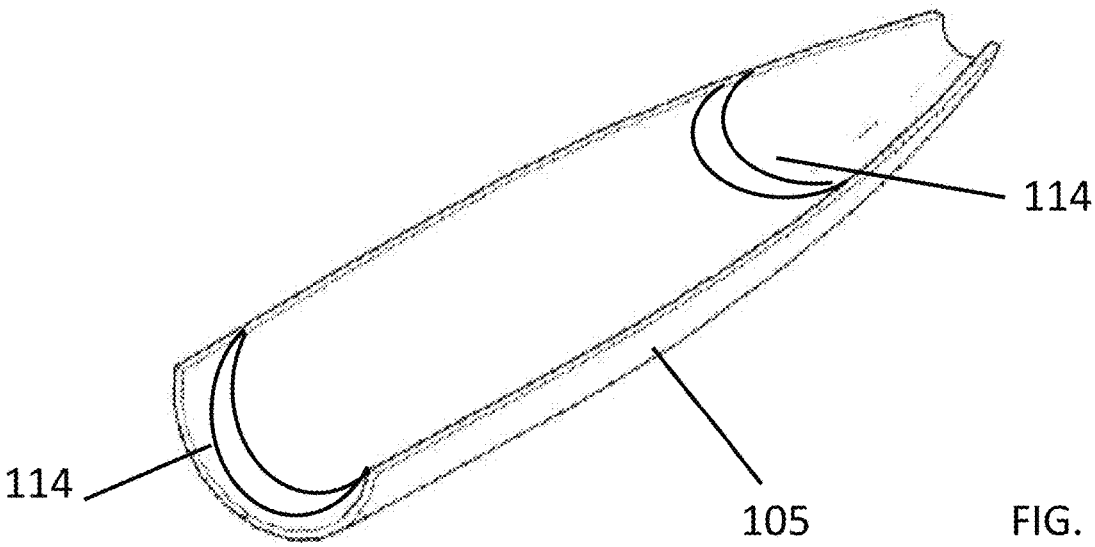
FIG. 8B illustrates a cutaway perspective view of the barrel member of the snowball launching and batting apparatus of the present invention.

In another embodiment, the barrel member 105, shown in FIGS. 8A-B of the snowball launching and batting apparatus 10 further comprises a plurality of threading structures 114 disposed upon an interior surface of the barrel member 105 near the first opening 106 or the second opening 107 of the barrel member 105. The threading structures are further configured to removably couple and retain the primary cradle structure 111 of the handle member 108, such that rotating either the barrel member 105 or the handle member 108 along a shared axis will couple the threading structures of the barrel member 105 to the primary cradle structure 111; and that rotation in the opposite direction would facilitate decoupling.

Figure 9A:
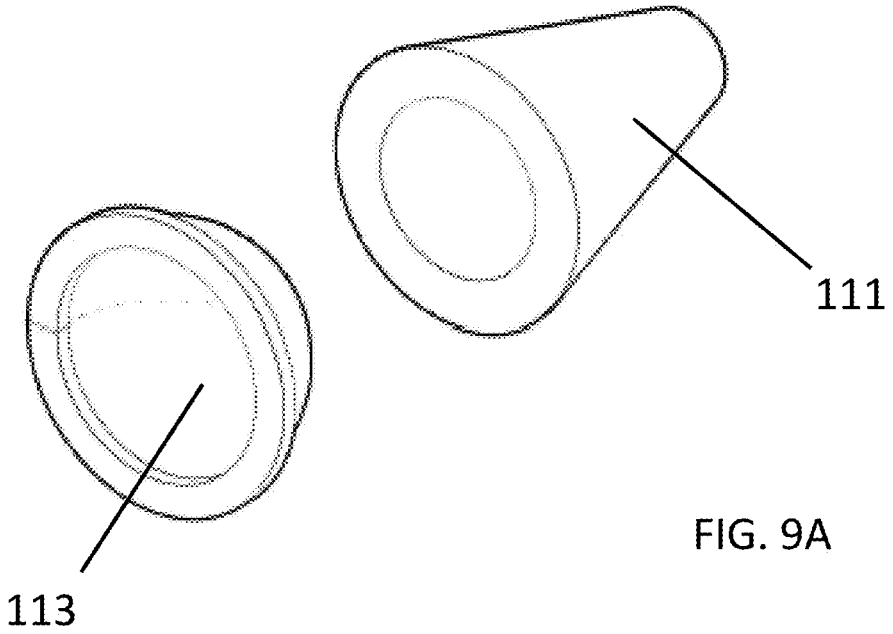
FIG. 9A illustrates a perspective view of the uncoupled primary cradle structure and the secondary cradle structure of the snowball launching and batting apparatus of the present invention.
Figure 9B:
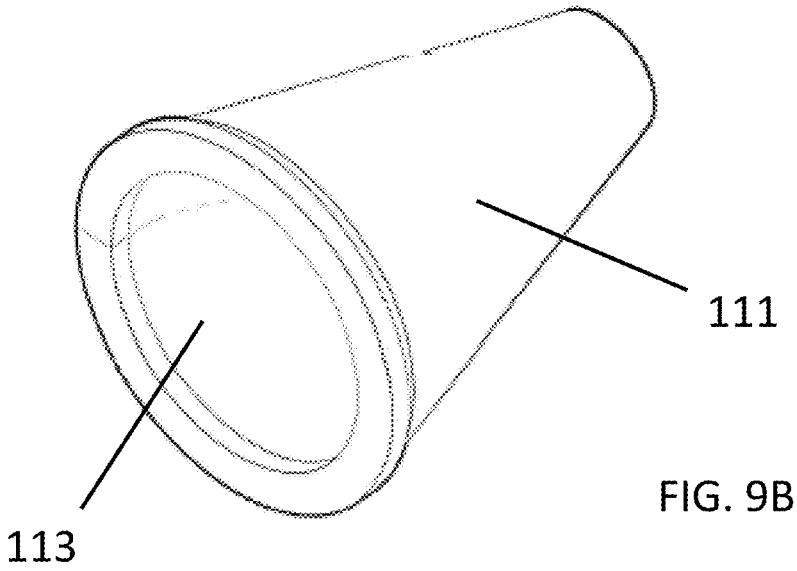
FIG. 9B illustrates a perspective view of the coupled primary cradle structure and the secondary cradle structure of the snowball launching and batting apparatus of the present invention.

In another embodiment of the invention, shown in FIGS. 9A-B, the primary cradle structure 111 of the handle member 108 further comprises threading features disposed along an externally-facing surface, the threading features configured to removably couple the plurality of threading structures 114 of the barrel member 105, such that rotating either the barrel member 105 or the handle member 108 along a shared axis will couple the threading structures of the barrel member 105 to the primary cradle structure 111; and that rotation in the opposite direction would facilitate decoupling.

The handle member 108 of the snowball launching and batting apparatus 10, shown in FIG. 9B, may further comprise a secondary cradle structure 113 removably coupled to the primary cradle structure 111, comprising a hollow semi-hemispheric structure configured to accept an amount of snow or at least one snowball and allow formation of a snowball when snow is pressed between the depression 115 and a user's hand. Extending radially outward from a central axis of the handle member 108, the secondary cradle structure 113 further comprises a lip member configured to couple the primary cradle structure 111. In some embodiments, the lip member extends outward and towards the second end 109 of the handle member 108, forming a channel spanning an equatorial circumference of the secondary cradle structure 113. In yet another embodiment, the channel may comprise threading disposed upon a surface of the secondary cradle structure 113 and within the channel, the threading configured to couple the threading features of the primary cradle structure 111, similar to a coupling between the primary cradle structure 111 and the barrel member 105 in other embodiments.

In other embodiments, the lip member of the secondary cradle structure 113 may be configured to couple the primary cradle structure 111 through friction fit, snap fit, or other removable coupling means. The secondary cradle structure 113 may further comprise threading disposed along an outward facing surface of the lip member, configured to removably couple the barrel member's plurality of threading structures 114, similar to a coupling between the primary cradle structure 111 and the barrel member 105 in other embodiments.

Figure 10:
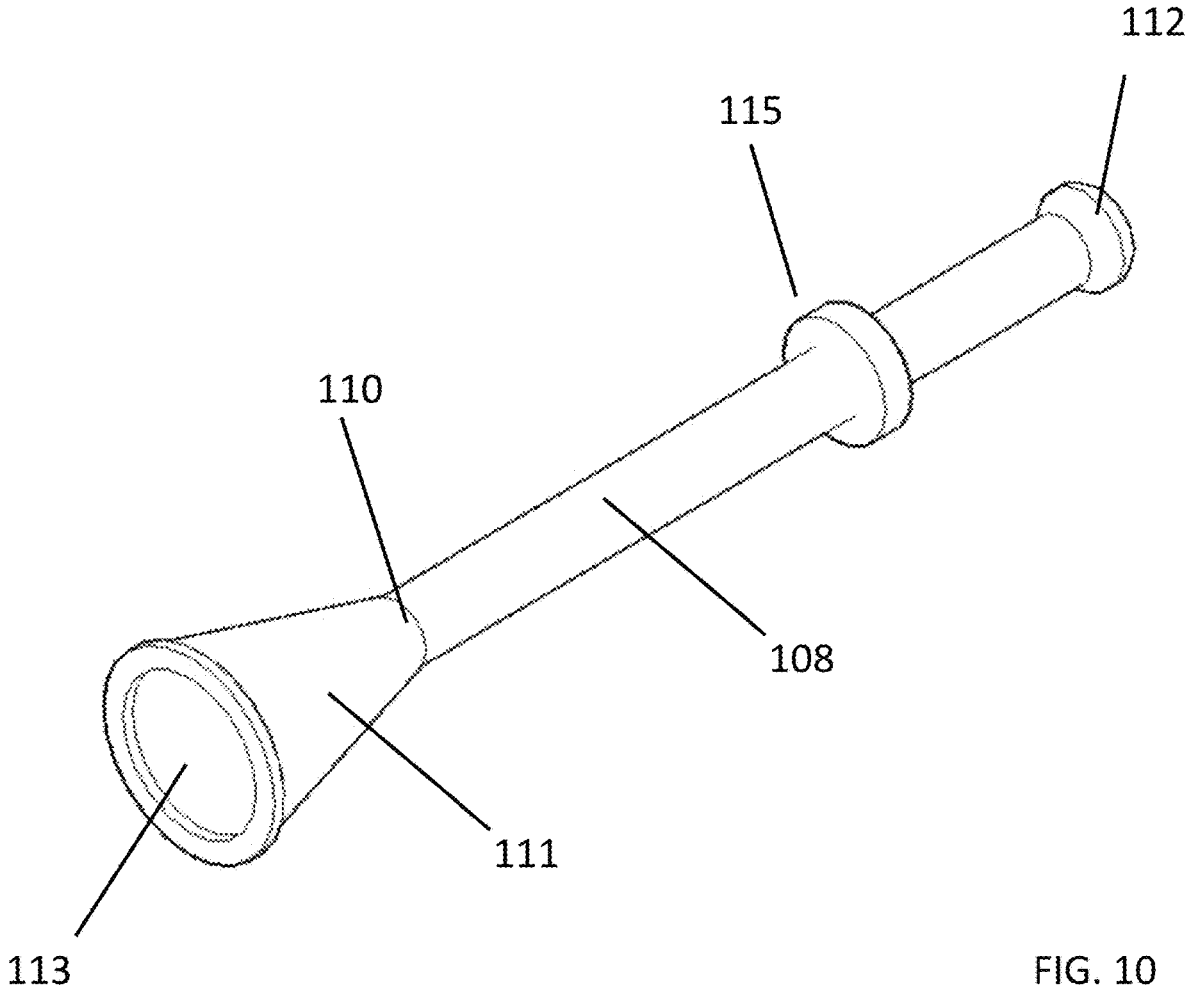
FIG. 10 illustrates a perspective view of the handle member of the snowball launching and batting apparatus with a coupled handle stop structure.

In some embodiments, shown in FIG. 10, the handle member 108 of the snowball launching and batting apparatus 10 further comprises a handle stop structure disposed along the surface of the member and extending radially outward from a central axis of the handle member 108. The handle stop structure is configured to prevent the handle member 108 from fully entering an interior of the barrel member 105, while also disposed along the handle member 108 at a distance such that a user may still grip the handle member 108 with at least one hand. A person of ordinary skill in the art will appreciate that the handle stop structure may be coupled to the handle member 108 in such a way that the handle stop structure cannot be removed, in such a way that it can be removed, or in such a way that it can be adjusted but not removed.

Figure 11A:
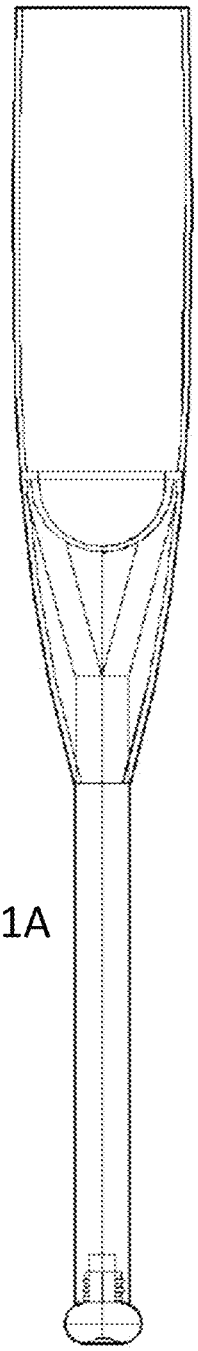
FIG. 11A illustrates a cutaway profile view of the snowball launching and batting apparatus configured in an extended state.

During some uses of the snowball launching and batting apparatus 10, starting in the extended state 101, a user first twists the handle member 108 such that the threading of the primary cradle structure 111 or the secondary cradle structure 113 decouples the plurality of threading structures 114 of the second opening 107 of the barrel member 105, ensuring the snowball launching and batting apparatus 10 is not locked in the extended state 101, as shown in FIG. 11A. The user then pushes the handle member 108 into the barrel member 105 until the primary cradle structure 111 or secondary cradle structure 113 abuts the plurality of threading structures 114 of the first opening 106 of the barrel member 105. Rotating either the barrel member 105 or the handle member 108 until the threading of the cradle structure engages and couples the plurality of threading structures 114 of the of the barrel member 105, thereby locking the snowball launching and batting apparatus 10 in the retracted state 102, shown in 11B. The user then inserts an amount of snow or at least snowball and fully forms at least one snowball by pressing an amount of snow between the user's hand and the cradle structure coupled to the first end 110 of the handle member 108. The user then performs the reverse steps of retracting the snowball launching and batting apparatus 10 in order to prepare the at least one snowball for launching. The user then has an option utilize the depression 115 of the knob structure to press and form snowballs for insertion into the barrel member 105 for launching. To launch the at least one snowball inserted into the barrel member 105, the user may swing the snowball launching and batting apparatus 10. The at least one snowball is then propelled out of the barrel member 105 through a centrifugal force applied by the user and sliding along an interior surface of the barrel member 105.

Figure 11B:
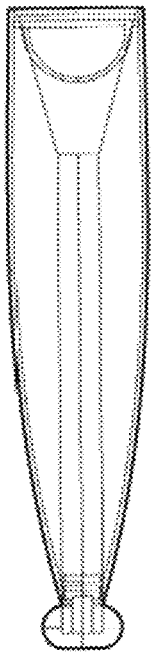
FIG. 11B illustrates a cutaway profile view of the snowball launching and batting apparatus configured in a retracted state.
Figure 12:
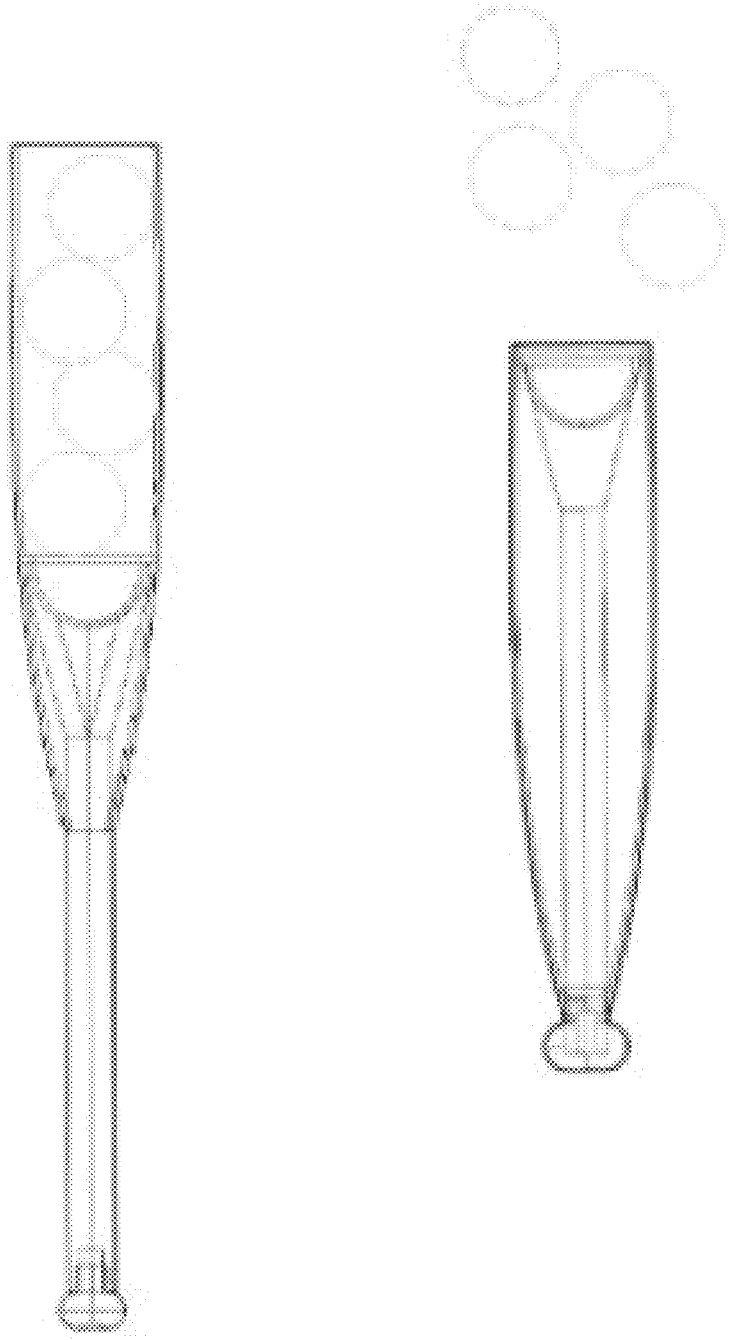
FIG. 12 illustrates exemplary profile views of the snowball launching and batting apparatus during use.

In some embodiments, as shown in FIG. 11, the step of launching the inserted at least one snowball may comprise the user holding the barrel member 105 with a first hand and applying a force to the handle member 108 along a central axis of the snowball launching and batting apparatus 10 with a second hand while it is in the extended state 101, but not locked into the state. The force applied to the handle member 108 moves the handle member 108 through the barrel member 105 and into the retracted state 102. As a result, the inserted at least one snowball is propelled from the barrel member 105 and launched.

In other embodiments of the invention, a user may skip the step of forming a snowball by pressing an amount of snow between a hand and the cradle structure of the handle member 108, instead inserting an amount of snow into the barrel member 105 that is in either a powdered or a non-structured form. The user then performs the steps of launching the amount of snow in said powdered or non-structured form.

Those of ordinary skill in the art will understand and appreciate that the foregoing description of the invention has been made with reference to certain exemplary embodiments of the invention, which describe a snowball launching and batting apparatus. Those of skill in the art will understand that obvious variations in construction, materials, dimensions or properties may be made without departing from the scope of the invention which is intended to be limited only by the claims appended hereto.

What is claimed is:

1. A snowball launching and batting apparatus, comprising:

a. a barrel member, the barrel member having a first opening and a second opening;

b. a handle member, the handle member having a first end and a second end;

c. a knob feature having an oblate ellipsoid structure and an elongate member;

d. the first opening of the barrel member further configured to accept the first end and the second end of the handle member;

e. the first opening of the barrel member further configured to accept an amount of snow or at least one snowball;

f. the second opening of the barrel member further comprising a plurality of threading structures disposed along an interior surface thereof, configured to couple and retain the second end of the handle member;

g. the second opening of the barrel member further comprising a plurality of threading structures disposed along an interior surface thereof, configured to couple and retain the first end of the handle member;

h. the first end of the handle member comprises a primary cradle structure configured to accept an amount of snow or at least one snowball;

i. the first end of the handle member further comprising a plurality of threading structures disposed along an exterior surface thereof and configured to couple and retain both the first opening of the barrel member and the second opening of the barrel member;

j. the second end of the handle member further comprising a plurality of threading structures disposed along an exterior surface thereof and configured to couple and retain the second opening of the barrel member; and k. the primary cradle structure further configured to form a snowball when an amount of snow is pressed between the cradle member and a user's hand.

2. The snowball launching and batting apparatus of claim 1, wherein the apparatus has an extended state and a retracted state.

3. The snowball launching and batting apparatus of claim 2, wherein the apparatus is configured to be locked in an extended state by coupling the plurality of threading structures of the second opening of the barrel member to the plurality of threading structures of the first end of the handle member.

4. The snowball launching and batting apparatus of claim 2, wherein the apparatus is configured to be locked in a retracted state by coupling the plurality of threading structures of the first opening of the barrel member to the plurality of threading structures of the second end of the handle member.

5. The snowball launching and batting apparatus of claim 2, wherein the barrel member comprises a plurality of threaded features disposed upon an interior surface and configured to couple and retain the primary cradle structure.

6. The snowball launching and batting apparatus of claim 5, wherein the primary cradle structure further comprises threading features disposed upon an outward surface and configured to couple the plurality of threaded features of the barrel member.

7. The snowball launching and batting apparatus of claim 2, wherein the handle member further comprises a secondary cradle structure removably coupled to the primary cradle structure and configured to accept an amount of snow or at least one snowball.

8. The snowball launching and batting apparatus of claim 7, wherein the secondary cradle structure is further configured to form a snowball when an amount of snow is pressed between the secondary cradle structure and a user's hand.

9. The snowball launching and batting apparatus of claim 8, wherein the secondary cradle structure further comprises a lip member extending radially from a central axis of the secondary cradle structure.

10. The snowball launching and batting apparatus of claim 9, wherein the lip member of the secondary cradle structure further comprises threading features disposed upon a surface and configured to couple the plurality of threading features of the barrel member.

11. The snowball launching and batting apparatus of claim 2, wherein the handle member further comprises a handle stop structure coupled to and extending radially from a central axis thereof, configured to prevent the handle member from fully entering the barrel member.

12. The snowball launching and batting apparatus of claim 2, wherein the handle member further comprises surface features configured to facilitate user grip.

13. The snowball launching and batting apparatus of claim 2, wherein the second end of the handle member comprises a threaded hole configured to couple the knob feature.

14. The snowball launching and batting apparatus of claim 13, wherein the knob feature further comprises a circular depression disposed upon a surface thereof.

15. A method of using a snowball launching and batting apparatus, comprising the steps of:

a. twisting a handle member such that at least one plurality of threading structures of the handle member decouples at least one plurality of threading members of a barrel member, thereby unlocking the apparatus from an extended state;

b. applying a force along a central axis of the apparatus, transforming the apparatus from an extended state to a compressed state;

c. twisting the handle member of the apparatus such that at least one plurality of threading structures of the handle member engages at least one plurality of threading members of the barrel member, thereby locking the apparatus in the compressed state;

d. inserting an amount of snow or at least one snowball into a cradle member of the apparatus;

e. compressing and forming the amount of snow or at least one snowball between a user's hand and the cradle member;

f. twisting the handle member of the apparatus such that at least one plurality of threading structures of the handle member decouples at least one plurality of threading members of the barrel member, thereby unlocking the apparatus from the compressed state;

g. applying a force along the central axis of the apparatus, transforming the apparatus from the compressed state to the extended state;

h. twisting the handle member of the apparatus such that at least one plurality of threading structures of the handle member engages at least one plurality of threading members of the barrel member, thereby locking the apparatus in the extended state; and i. swinging the apparatus in a radial fashion, such that the amount of snow or at least one snowball has a centrifugal force applied to it, launching the amount of snow or at least one snowball from the apparatus.

* * * * *